United States Patent [19]

Modine

[11] 4,019,573

[45] Apr. 26, 1977

[54] HEAT EXCHANGER

[75] Inventor: Arthur B. Modine, Racine, Wis.

[73] Assignee: Modine Manufacturing Company, Racine, Wis.

[22] Filed: Sept. 25, 1975

[21] Appl. No.: 616,670

[52] U.S. Cl. ..... 165/175; 165/153; 165/177; 165/DIG. 13

[51] Int. Cl.[2] ..... F28F 1/02; F28F 1/38; F28F 9/00; F28D 7/00

[58] Field of Search ..... 165/DIG. 13, 175, 172, 165/153, 177

[56] References Cited

FOREIGN PATENTS OR APPLICATIONS

| | | | |
|---|---|---|---|
| 106,773 | 2/1927 | Austria | 165/177 |
| 953,578 | 12/1949 | France | 165/177 |
| 841,008 | 5/1939 | France | 165/177 |
| 793,474 | 1/1936 | France | 165/175 |
| 472,779 | 12/1914 | France | 165/177 |
| 4,517 | 3/1888 | United Kingdom | 165/177 |
| 1,347 | 11/1957 | United Kingdom | 165/177 |

*Primary Examiner*—C. J. Husar
*Assistant Examiner*—Sheldon Richter
*Attorney, Agent, or Firm*—Wegner, Stellman, McCord, Wiles & Wood

[57] ABSTRACT

A heat exchanger for exchanging heat between fluids comprising a conduit for flow of a first fluid therethrough comprising a manifold with a single port in one area and a pair of ports in another area and a plurality of spaced fluid tubes attached to the pair of ports with the combination of the plurality of tubes having outer peripheral surfaces describing a cylinder and the inner confronting peripheral surfaces spaced apart to provide an open area therebetween for flow of a second fluid therethrough and means for directing the second fluid over and around both the inner and outer peripheral surfaces and through the open area between the tubes for achieving maximum surface area heat transfer with minimum cross sectional area of the conduits.

12 Claims, 9 Drawing Figures

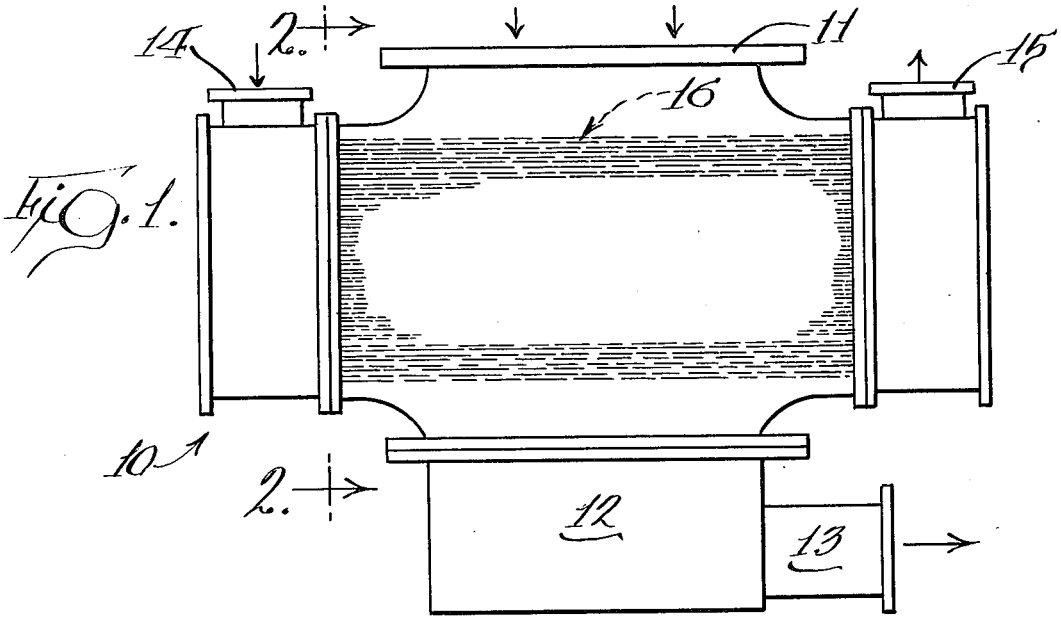
Fig. 1.
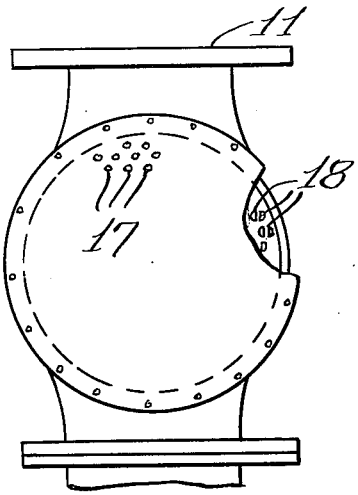
Fig. 2.
Fig. 3.
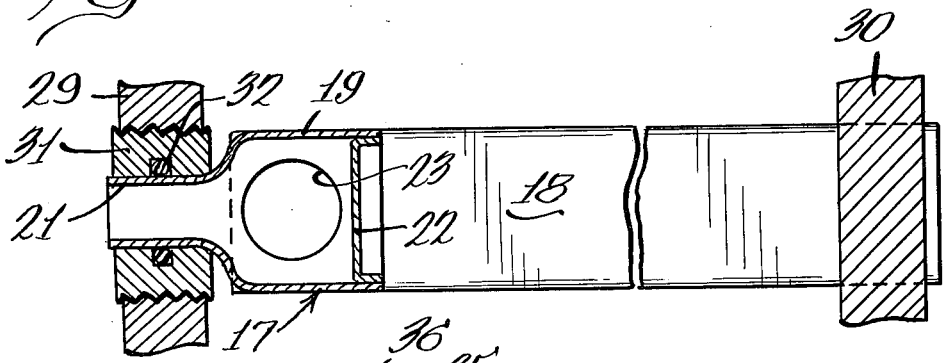
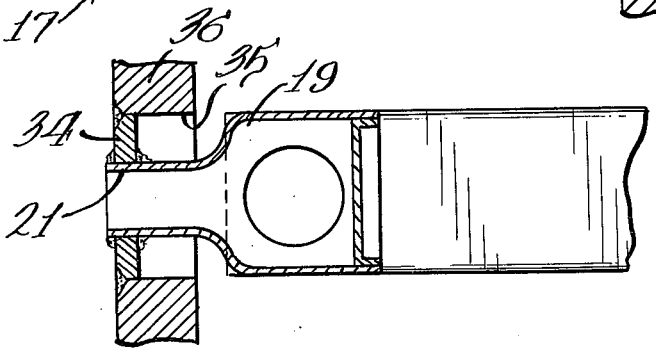
Fig. 4.

16
17
18
19
20
21
22
23
24
25
26
27
28
29
30
31
32
33

HEAT EXCHANGER

SUMMARY OF THE INVENTION

One of the features of this invention is to provide a heat exchanger for exchanging heat between fluids wherein the heat exchanger comprises conduits each of which includes a plurality of tubes that are spaced apart to provide an inner flow area for a second fluid and with the outer peripheral areas of the combination of tubes lying along a cylinder so that the conduit will occupy the minimum amount of space to provide a maximum amount of heat exchange surface area on the conduit.

BRIEF DESCRIPTION OF THE DRAWINGS

FIG. 1 is a side elevational view of one embodiment of the invention as embodied in a surface condenser for a steam power plant.

FIG. 2 is a vertical sectional view taken substantially along line 2—2 of FIG. 1 with a portion broken away for clarity of illustration.

FIG. 3 is an enlarged sectional view that is foreshortened and illustrating a conduit embodying the invention in combination with the header plates at the opposite ends of the conduit.

FIG. 4 is a view similar to FIG. 3 but illustrating another embodiment wherein the conduit manifold is metallurgically bonded or welded to the header plate or tube sheet.

DESCRIPTION OF THE PREFERRED EMBODIMENTS

Figures 5, 6:
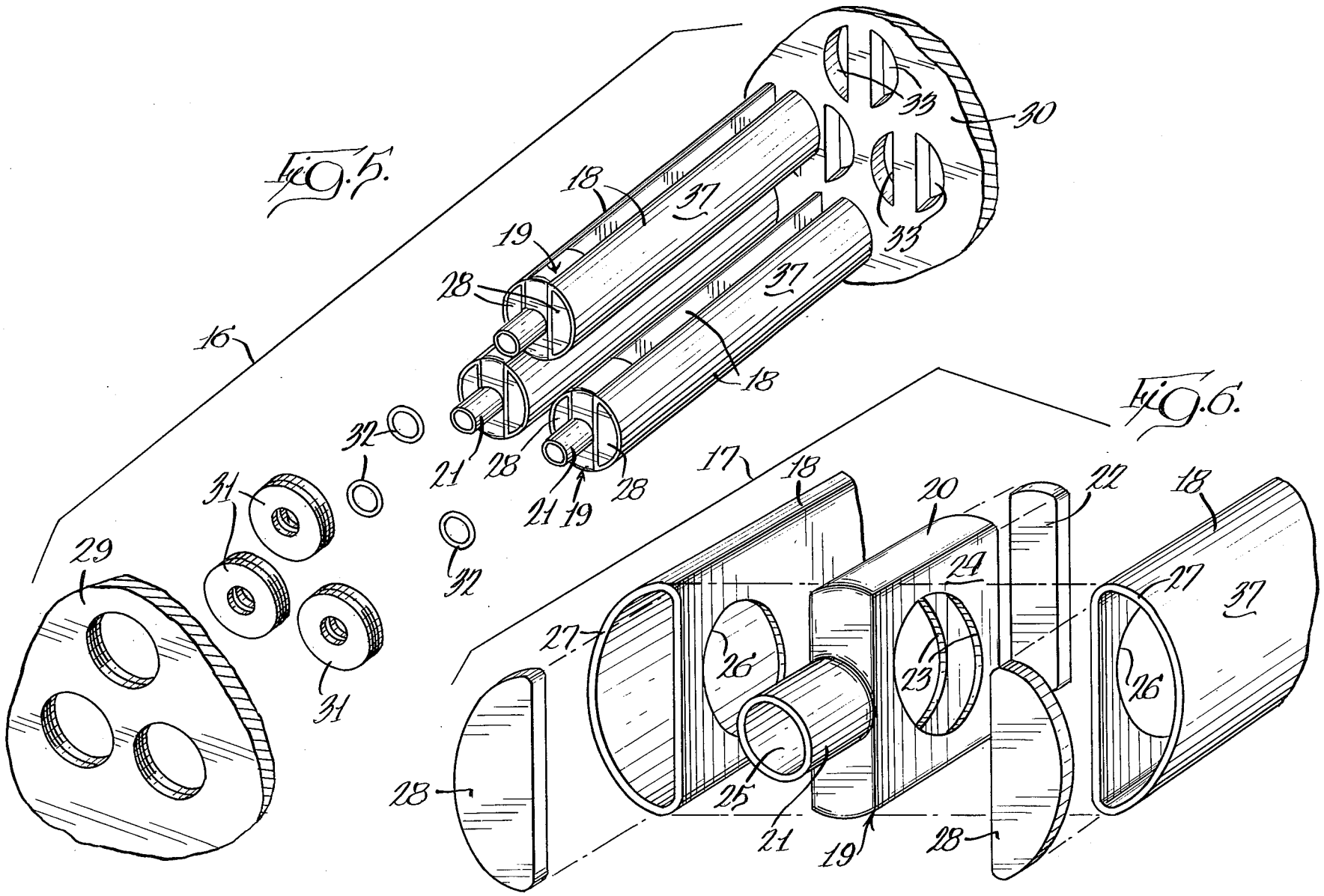
FIG. 5 is an exploded view of a heat exchanger tube bundle embodying the invention.
FIG. 6 is an exploded view of the tube and manifold combination of the invention.

In the embodiment of FIGS. 1 and 2 there is illustrated a surface condenser 10 for a steam power plant and embodying the invention. This condenser is provided with a steam inlet 11 at the top, a hot well 12 at the bottom and a condensate outlet 13 leading from the hot well 12. The surface condenser 10 is provided with the customary cooling water inlet 14 at one end and water outlet 15 at the other.

Within the condenser 10 and extending between the inlet 14 and outlet 15 is the tube bundle 16. The tube bundle 16 comprises a parallel plurality of conduits 17 each of which comprises a pair of spaced tubes 18.

As is illustrated most clearly in FIGS. 3-6 each conduit comprises in addition to the pair of spaced tubes 18 a manifold 19 that comprises a flat sandwich member 20 of rectangular cross section having a cylindrical extension 21 at one end, a closure plate 22 at the other end and a pair of transversely aligned openings or ports 23 at the opposite sides 24 of the manifold 19. As can be seen most clearly in the exploded view of FIG. 6 the cylindrical extension 21 comprises a port 25 that is at essentially right angles to the lateral ports provided by the openings 23.

The spaced tubes 18 of each conduit 17 each has a side opening 26 located adjacent to the corresponding end 27 of the tubes 18 and these openings 26 when the parts are assembled substantially coincide with the manifold openings 23. Then the end 27 of each tube 18 is provided with a closure cap 28 that is similar in function to the closure plate or cap 22 of the manifold 19.

The conduits 17 are held in parallel arrangement between header plates or tube sheets 29 and 30. In the embodiment of FIGS. 3 and 5 this is accomplished by providing annular threaded inserts 31 threaded into the forward plate 29 into which insert the cylindrical extension 21 of the manifold 19 extends and is sealed thereto with a fluid tight joint by a customary O-ring 32. The opposite ends of the tubes 18 are held in openings 33 shaped to secure the ends of the tubes 18 in the rear header plate 30.

The embodiment of FIG. 4 is similar to that of FIG. 3 except in this embodiment the manifold 19 tubular extension 21 is held in position by being welded to a plate insert 34 which itself is welded to an opening 35, in this embodiment of a header plate or tube sheet 36.

Figure 7:
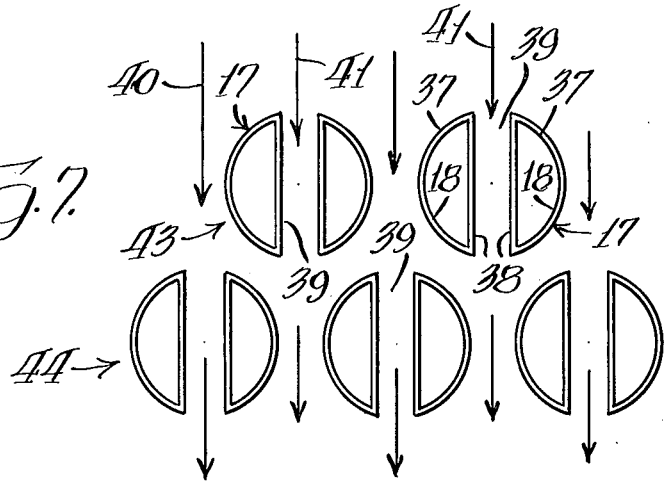
FIG. 7 is a cross sectional view illustrating one embodiment of a flow path for the second fluid over and through the conduits in heat exchange relationship with the first fluid flow through the conduits.
Figure 8:
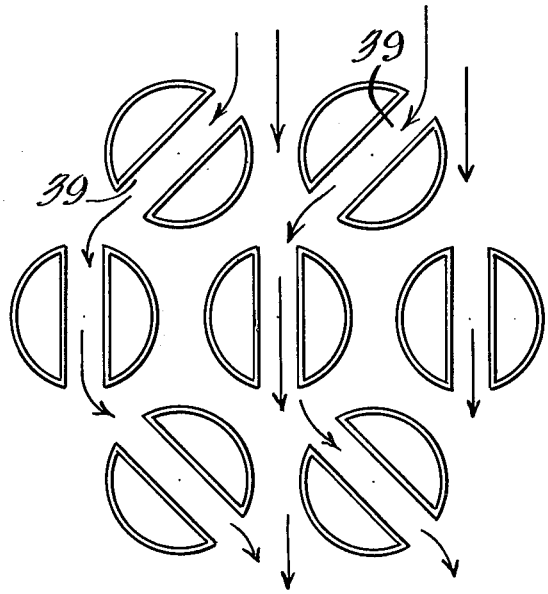
FIG. 8 is another embodiment similar to FIG. 7 with the tubes being arranged in a different manner.

In order to achieve maximum surface contact for efficient heat transfer with minimum special requirements the conduit tubes 18 have outer peripheral surfaces 37 that comprise portions of a cylinder, as can be seen from the transverse sectional views of the embodiments of FIGS. 7 and 8. The tubes 18 also have confronting inner surfaces 38 that are spaced apart to provide an open area 39 which in the illustrated embodiment has parallel sides provided by these inner surfaces 38. With this arrangement the combination of the cylindrical surface portions 37 arranged to define a cylinder and the open areas 39 provide maximum surface for efficient heat transfer between the fluids flowing through the tubes 18 such as the illustrated cooling water and the fluids 40 and 41 flowing over the surfaces of the tubes 18. This maximum surface area for efficient heat transfer between the fluids is achieved with minimum space requirements because of the surfaces 37 describing the cylinders.

This means that more of the tubes 18 comprising the conduits 17 can be arranged in a given space such as the heat exchange space within the surface condenser 10. It is, of course, obvious that these shapes can deviate from an exact cylinder but if so it will be at the cost of occupying more space. Therefore, the cylindrical sections for these outer surfaces 37 and the spacing of the tubes so that these surfaces describe a cylinder is a preferred construction although of course deviations from this are possible while still achieving the major advantages of this invention.

When the tubes 18 are arranged as illustrated in FIG. 7 the fluid flow is as illustrated with some of the fluid 40 flowing around and between the tubes while other portions 41 of the fluid flow through the open areas 39. In order that this flow 41 through these areas 39 will be relatively unrestricted it is preferred that the inner surfaces 38 describing these areas be essentially flat and essentially parallel. For improved heat transfer the tubes may be arranged in groups such as illustrated at 43 and 44 in FIG. 7 with the open areas 39 in the two groups being laterally staggered with respect to each other.

In another embodiment the open areas 39 in the different groups of tubes may be angularly arranged with respect to each other as illustrated in FIG. 8 for somewhat improved heat transfer.

If desired each open area 39 between the parallel tubes 18 may be provided with a heat transfer fin occupying the space 39 and extending between the tube inner surfaces 38. This fin 46 may be the customary undulating fin as illustrated in the fragmentary view of FIG. 9.

The heat exchanger of this invention permits replacing rounded tubes in existing heat exchanger designs with two or more smaller tubes in an assembly that occupies substantially the same space as the customary round tube but with greater surface area for improved heat transfer and thereby better performance. As can be seen from the illustrated embodiment the ideal arrangement is to have a pair of the tubes with each being essentially D-shaped and any desired means of connecting the tubular conduit assemblies to the manifold plates or tube sheets may be used.

Another advantage of the structure of this invention is that desired flow patterns as illustrated in FIGS. 7 and 8 may be achieved for flow of fluid over these tube surfaces merely by rotating the conduits to the desired positions relative to each other and to the flow of the second fluid.

Figure 9:
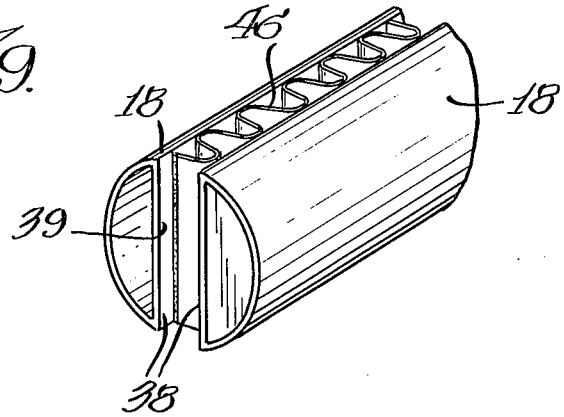
FIG. 9 is a fragmentary perspective view illustrating the conduit tubes in combination with a heat exchange fin.

The provision of the intermediate fin 46 of FIG. 9 between the spaced tubes 18 in the open area 39 not only improves the heat transfer but also gives added strength to the assembly of the plurality of tubes 18 due to the metallurgical bond between the fin 46 and the tube surfaces 38. This not only provides support but increases the internal pressure that the tubes 18 can withstand without damage.

The greater surface area that the heat exchanger of this invention provides is illustrated in one embodiment where two spaced D-shaped tubes replaced a single circular tube. In this embodiment the two D-shaped tubes had a 4.64 inches circumference while the tube it replaced had only a 2.356 inches circumference. The greatly increased heat exchange contact area in substantially the same space provided by this invention is thereby apparent.

Having described my invention as related to the embodiments shown in the accompanying drawings, it is my intention that the invention be not limited by any of the details of description, unless otherwise specified, but rather be construed broadly within its spirit and scope as set out in the appended claims.

I claim:

1. A heat exchanger for exchanging heat between fluids, comprising: a plurality of conduits for parallel flow of a first fluid through all said conduits, each said conduit comprising a manifold with a first port at one end and a plurality of adjacent second ports spaced from said first port and a plurality of fluid tubes each attached to one of said plurality of ports, the outer peripheral surfaces of the plurality of tubes of each said conduit substantially describing a conduit cylinder and the inner confronting surfaces of said tubes of each conduit being spaced apart to provide an open fluid flow area between the tubes; means for directing a first fluid through all said conduits and thereby all said tubes; and means for directing a second fluid over and around said outer peripheral surfaces and through said open areas between the tubes for achieving maximum surface area contact heat transfer with minimum cross sectional area of each of the conduits.

2. The heat exchanger of claim 1 wherein said confronting surfaces of said spaced tubes are essentially flat.

3. The heat exchanger of claim 1 where said confronting surfaces of said spaced tubes are essentially flat and substantially parallel.

4. The heat exchanger of claim 1 wherein each said manifold comprises a flat fluid flow member having opposite ends and opposite sides, a single said first port at one said end and a pair of said second ports facing outwardly on said opposite sides of said manifold and communicating with a pair of said spaced tubes located at said side ports.

5. The heat exchanger of claim 1 wherein each conduit comprises a pair of said second ports and a corresponding pair of said tubes.

6. The heat exchanger of claim 5 wherein each of said pair of tubes comprising a conduit is of a cross section having an arcuate outer surface and a flat base inner surface facing the corresponding flat surfaces of the other tube and with said bases being spaced apart, the outer surfaces of said pair of tubes lying on a cylinder whose axial center substantially coincides with the central axis of said first port.

7. The heat exchanger of claim 6 wherein said open area between said tubes is provided with a heat transfer fin.

8. The heat exchanger of claim 6 wherein said open areas between the pairs of tubes comprising said conduits are parallel for substantially parallel flow of said second fluid therethrough.

9. The heat exchanger of claim 6 wherein said open areas between the pairs of tubes comprising said conduits are arranged for angular flow through successive said areas.

10. The heat exchanger of claim 6 wherein the spacing of said bases of each conduit is substantially uniform throughout the length of said conduit.

11. The heat exchanger of claim 10 wherein each said manifold comprises a flat fluid flow member having opposite ends and opposite sides, a single said first port at one said end and a pair of said second ports facing outwardly on said opposite sides of said manifold and communicating with a pair of said spaced tubes located at said side ports.

12. The heat exchanger of claim 11 wherein said pairs of tubes comprising said conduits are in groups with the open areas between the tubes of each group being parallel and the open areas of one group being staggered laterally with respect to those of the next adjacent group.

* * * * *